US005571000A

United States Patent [19]

Zimmermann et al.

[11] Patent Number: 5,571,000

[45] Date of Patent: Nov. 5, 1996

[54] BOOSTER PUMP WITH BYPASS VALVE INTEGRALLY FORMED IN GASKET

[75] Inventors: Oskar Zimmermann, Anaheim; Hal P. Voznick, Chino, both of Calif.

[73] Assignee: Shurflo Pump Manufacturing Co., Santa Ana, Calif.

[21] Appl. No.: 515,453

[22] Filed: Aug. 15, 1995

Related U.S. Application Data

[62] Division of Ser. No. 267,796, Jul. 7, 1994, Pat. No. 5,476, 367.

[51] Int. Cl.[6] ..... F04B 49/00

[52] U.S. Cl. ..... 417/307; 417/311; 417/440; 137/510; 137/512.4

[58] Field of Search ..... 417/415, 413.1, 417/440, 521, 551, 566, 269, 296, 307, 311; 137/510, 512.4; 277/29

[56] References Cited

U.S. PATENT DOCUMENTS

| | | | |
|---|---|---|---|
| 2,942,550 | 6/1960 | Carter | 417/307 |
| 2,971,470 | 2/1961 | Wein et al. . | |
| 3,314,600 | 4/1967 | Hadley | 417/566 |
| 3,572,375 | 3/1971 | Rosenberg | 417/566 |
| 3,684,406 | 8/1972 | Edwards . | |
| 4,153,391 | 5/1979 | Hartley | 417/269 |
| 4,305,702 | 12/1981 | Hartley | 417/566 |
| 4,396,357 | 8/1983 | Hartley | 417/269 |
| 4,507,058 | 3/1985 | Shoenmeyr . | |
| 4,545,735 | 10/1985 | Ims | 417/307 |
| 4,610,605 | 9/1986 | Hartley | 417/269 |
| 4,646,781 | 3/1987 | McIntyre et al. | 137/512.4 |
| 5,129,794 | 7/1992 | Beatty . | |
| 5,203,803 | 4/1993 | Schoenmeyr | 417/296 |
| 5,301,663 | 4/1994 | Small, Jr. . | |
| 5,344,292 | 9/1994 | Rabenau et al. . | |

FOREIGN PATENT DOCUMENTS

| | | | |
|---|---|---|---|
| 93674 | 11/1983 | European Pat. Off. | 417/566 |
| 509224 | 9/1930 | Germany . | |
| 1907454 | 2/1969 | Germany . | |
| 404255593 | 9/1992 | Japan | 417/440 |
| 654636 | 6/1951 | United Kingdom . | |

*Primary Examiner*—Timothy S. Thorpe
*Assistant Examiner*—Ted Kim
*Attorney, Agent, or Firm*—Frank J. Uxa

[57] ABSTRACT

A pump comprising a housing including first and second housing sections and a gasket between the first and second housing sections. The housing has a first pumping chamber, an inlet, an inlet passage in the housing leading from the inlet to the pumping chamber, an outlet and an outlet passage in the housing leading from the pumping chamber to the outlet. A pumping member is movable in the pumping chamber to pump fluid through the pump. Inlet and outlet check valves are provided in the inlet and outlet passages, respectively with each of the check valves including a movable valve element. The gasket forms a seal between the first and second housing sections. A bypass passages (140) in the housing leads from a location in the outlet passage downstream of the outlet check valve to a location in the inlet passage upstream of the inlet check valve. A bypass valve is provided and includes a bypass valve seat in the bypass passages, a region of the gasket and a biasing member for biasing the gasket region against the bypass valve seat to close the bypass passage.

10 Claims, 6 Drawing Sheets

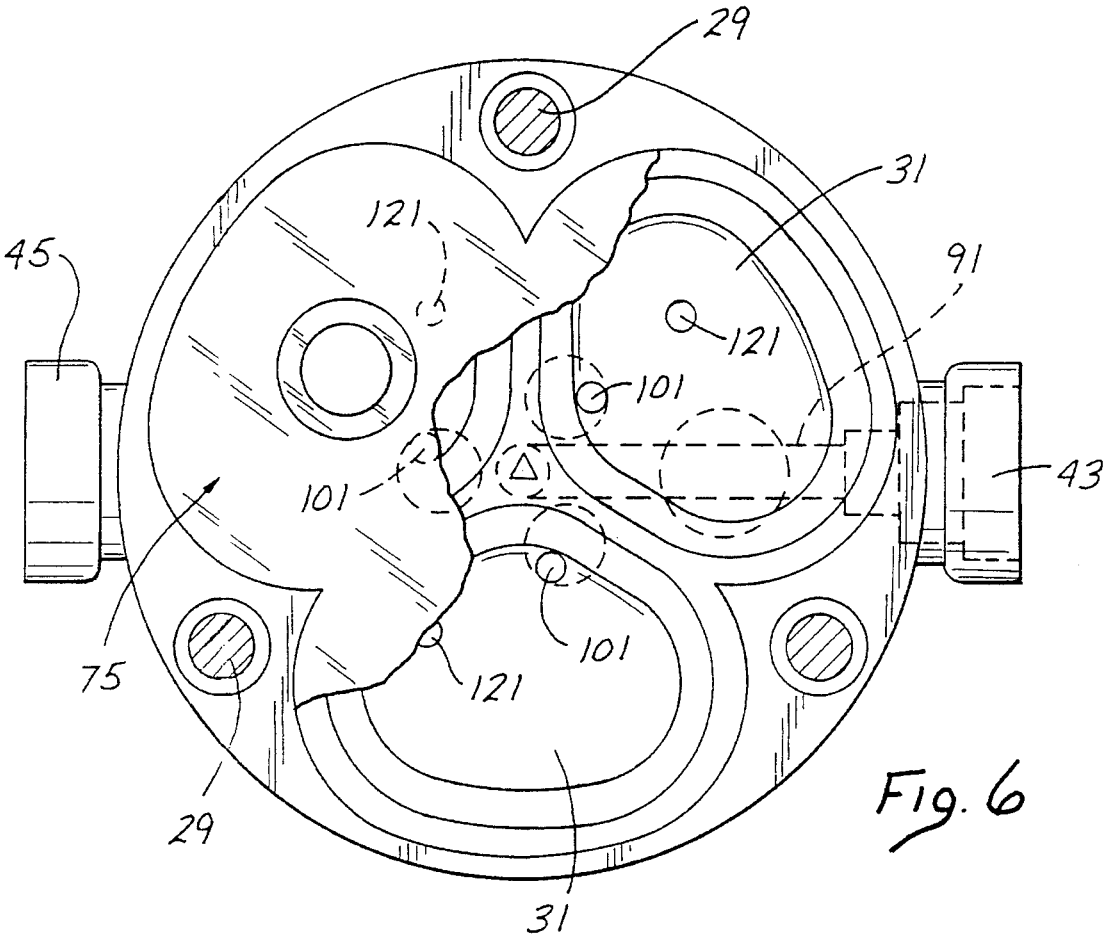
Fig. 6
Fig. 7
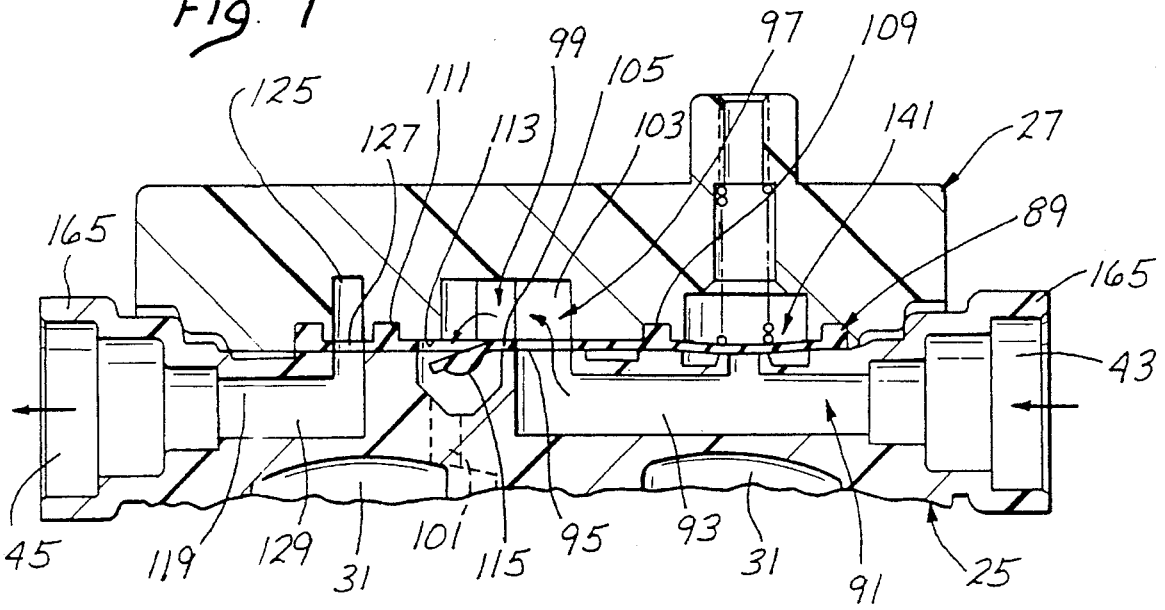

BOOSTER PUMP WITH BYPASS VALVE INTEGRALLY FORMED IN GASKET

This application is a division of application Ser. No. 08/267,796, filed Jul. 7, 1994, now U.S. Pat. No. 5,476,367.

BACKGROUND OF THE INVENTION

This invention relates to a pump and more particularly to a positive displacement booster pump useful for pumping various liquids, such as water.

Pumps have been known for many years and the pump field is highly developed. One kind of pump which has been found very useful in pumping various liquids, such as water, is a diaphragm pump driven by a wobble plate. Pumps of this general nature are shown by way of example in Hartley Pat. Nos. 4,153,391 and 4,610,605.

Although diaphragm pumps of this type have been found very useful, there is an ongoing need to reduce the number of parts, simplify construction and assembly and reduce cost. It is also desirable to minimize the number of potential leak paths, and all of this must be accomplished while maintaining maximum efficiency.

SUMMARY OF THE INVENTION

This invention achieves these goals. Specifically, the number of parts and potential leak paths are reduced and assembly is facilitated while maintaining or increasing pump efficiency.

One feature of this invention is to use a gasket for multiple functions thereby obtaining multiple functions out of what may be a single integral component of the pump. For example, with this invention a gasket may be utilized to both form a seal between first and second housing sections of the pump and to provide a valve element for either or both of the inlet and outlet check valves of the pump. Alternatively or in addition thereto the gasket may be used to both seal between first and second housing sections of the pump and to cooperate with at least one of the housing sections to form an inlet and/or outlet chamber for the pump. According to another feature of the invention, a gasket is used to provide the valve elements for both the inlet and outlet check valves of the pump.

It is sometimes necessary or desirable for a pump to have a bypass passage in the housing leading from a location in the outlet passage downstream of the outlet check valve to a location in the inlet passage upstream of the inlet check valve. A bypass valve opens in response to fluid under pressure from the outlet passage exceeding some magnitude to allow flow through the bypass passage back toward the inlet.

Another feature of this invention is that the bypass valve may include a region of the gasket and a biasing member for biasing such region of the gasket against a bypass valve seat to close the bypass passage. This region of the gasket is responsive to the fluid under pressure from the outlet passage exceeding some magnitude for moving off the bypass valve seat to open the bypass. The gasket also serves to keep the biasing member in a part of the housing which is not subjected to the fluid being pumped.

Another feature of the invention is particularly useful when the pump includes a wobble plate for driving a pumping member and a wobble mechanism for imparting wobbling motion to the wobble plate. A diaphragm is used between the wobble plate and the pumping member for sealing one end of a pumping chamber in which the pumping member moves. In this event, the pumping member may have a pedestal which engages the diaphragm to assist in transmitting the wobbling motion to the pumping member. The pedestal is believed to transmit the wobbling motion in a smooth manner.

A pump constructed in accordance with this invention may comprise a housing including first and second housing sections, a gasket between the first and second housing sections and at least one fastener for holding the housing sections together. The housing has at least a first pumping chamber, an inlet, an inlet passage in the housing leading from the inlet to the pumping chamber, an outlet and an outlet passage in the housing leading from the pumping chamber to the outlet. A first pumping member is movable in the pumping chamber on an intake stroke wherein a fluid from the inlet passage is drawn into the pumping chamber and a discharge stroke wherein fluid in the pumping chamber is discharged into the outlet passage. A drive is provided for moving the pumping member on the intake and discharge strokes. An inlet check valve and an outlet check valve are provided in the inlet passage and the outlet passage, respectively with each of the check valves including a movable valve element and a valve seat. The gasket forms a seal between the first and second housing sections and performs any one or more of the following functions: (i) provides one or more of the valve elements of the inlet and outlet check valves, (ii) cooperates with at least one of the housing sections to form a chamber in one of the inlet and discharge passages, and/or (iii) forms a portion of a bypass valve. Alternatively, the gasket may not form a seal between housing sections and provide the valve elements for both the inlet and outlet check valves.

Preferably the gasket includes a hinge of flexible material joined to the valve element whereby the valve element can be pivoted between open and closed positions. Viewed from a different perspective, the gasket includes a section of flexible material and the valve element is integrally joined to such section about a hinge. Although the gasket can be formed from multiple components, preferably it is integrally molded as a unitary, one piece element.

The invention, together with additional features and advantages thereof may best be understood by reference to the following description taken in connection with the accompanying illustrative drawings.

BRIEF DESCRIPTION OF THE DRAWINGS

FIG. 6 is a view taken generally along line 6—6 of FIG. 2 with a portion of the diaphragm broken away and with two of the pistons removed.

FIGS. 7, 8 and 9 are fragmentary sectional views taken generally along lines 7—7, 8—8 and 9—9 of FIG. 5.

DESCRIPTION OF THE PREFERRED EMBODIMENT

Figure 1:
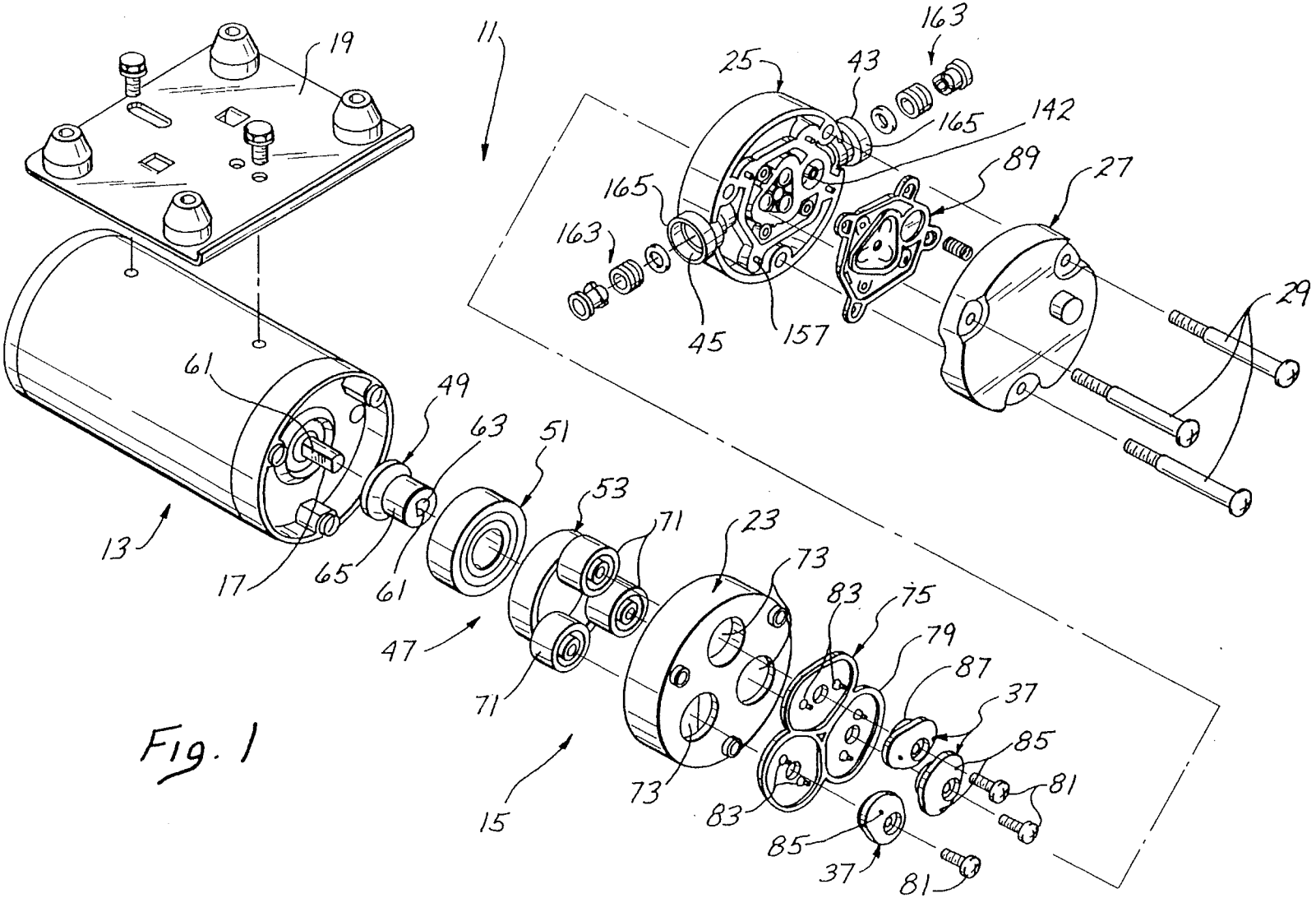
FIG. 1 is an exploded perspective view of one preferred form of pump constructed in accordance with the teachings of this invention.

FIG. 1 shows a pump assembly 11 which generally comprises a motor 13 and a pump 15. The motor 13 may be a conventional 110 volt AC motor having a rotatable output shaft 17 and a base plate 19.

The pump 15 includes a housing 21 (FIG. 2) which includes an inner housing section 23, an intermediate housing section 25 and an outer housing section or cover 27 (FIGS. 1 and 2) which are held together and mounted on the motor 13 in any suitable manner such as by threaded fasteners 29 (FIG. 1). Each of the housing sections 23, 25 and 27 is preferably a one piece, molded member of a suitable polymeric material. As described more fully below, the pump 15, and in particular the intermediate housing section 25 has three identical pumping chambers 31 which are equally spaced circumferentially (FIG. 2) and these pumping chambers have identical pumping members 37, respectively, movable in the pumping chambers to pump a fluid or liquid such as water through the pump from an inlet 43 to an outlet 45. Although the pumping members 37 can be any kind of member that will pump a fluid, in this embodiment each of them is in the form of a piston.

Figure 2:
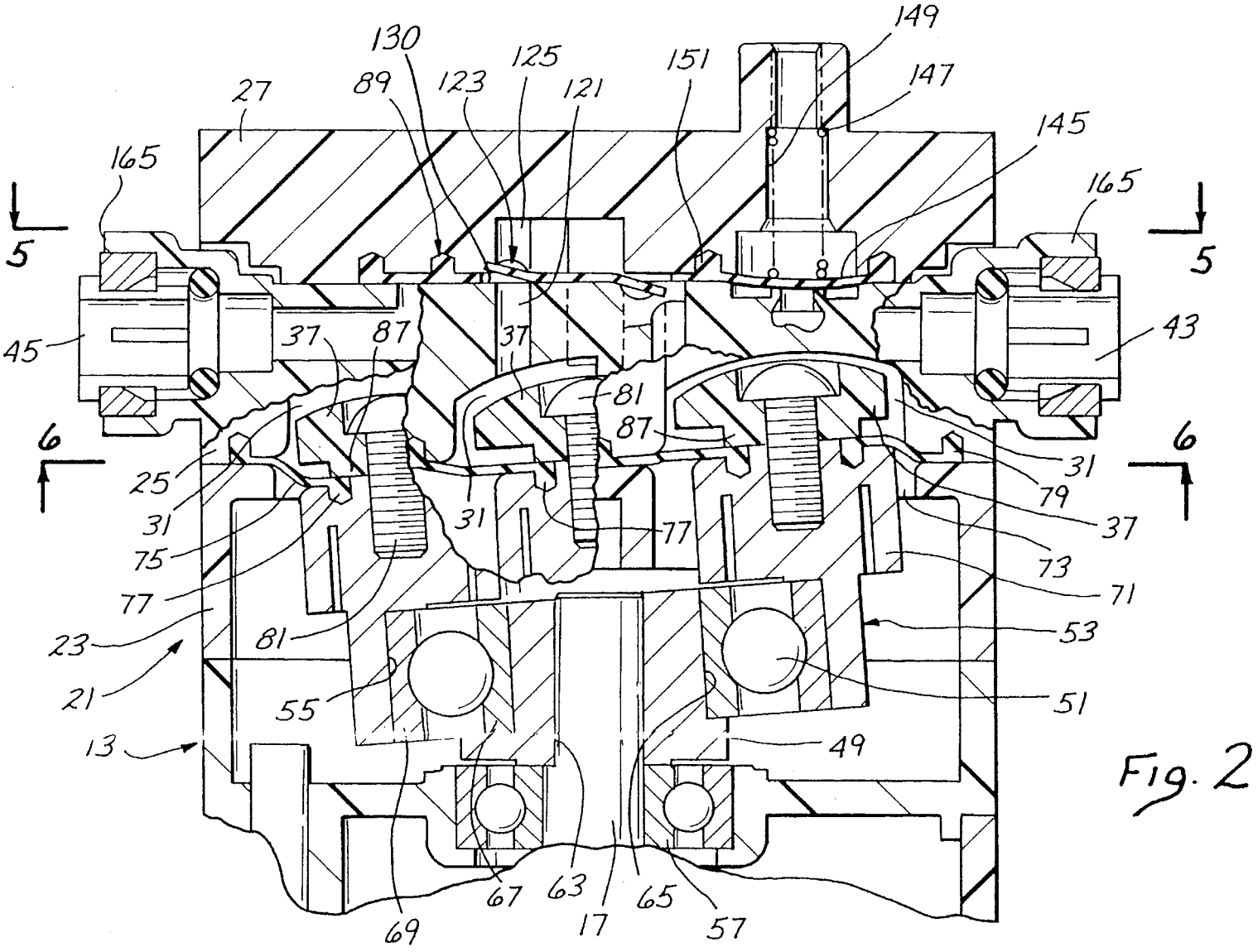
FIG. 2 is an enlarged fragmentary sectional view taken on a generally axial plane through the pump with parts broken away.

A drive 47 (FIG. 1) moves the pumping members 37 in the associated pumping chambers 31. Although the drive 47 may be any device which accomplishes this function, this embodiment it includes a bushing 49 driven by the output shaft 17 of the meter 13, a ball bearing 51 which receives a portion of the bushing 47 as shown in FIG. 2 and a wobble plate 53 which has a pocket 55 in which the ball bearing 51 is received. The bushing 49 and the bearing 51 form a wobble mechanism for imparting wobbling motion to the wobble plate 53. As shown in FIG. 2, the output shaft 17 is rotatably supported by a bearing 57 supported by a motor housing 59 of the motor. Flats 61 on the output shaft 17 and on a bore 63 through the bushing 49 enables the output shaft to rotate the bushing. The bushing 49 has a cylindrical surface 65 with an axis which is skewed relative to the axis of the bore 63 and the ball bearing 51 has an inner race 67 which is suitably affixed to the cylindrical surface 65 and an outer race 69 which is suitably affixed to the wobble plate 53. Accordingly, rotation of the output shaft 17 causes the wobble plate 53 to undergo a wobbling or nutating motion which can sequentially drive the pumping members 37 on intake and discharge strokes. The drive 47 is not novel per se, and a similar wobble plate drive is shown in Hartley U.S. Pat. No. 4,396,357.

The wobble plate 53 is received within the inner housing section 23 and has three projections 71 (FIG. 1) which are received respectively in three openings 73 of the inner housing section. A diaphragm 75 of a suitable flexible, resilient material, which may be a polymeric material or an elastomer with Santoprene sold by Monsanto being preferred, is sandwiched between the inner housing section 23 and the intermediate housing section 25. The diaphragm 75 is formed with integral annular seals 77 (FIG. 2) for forming a fluid tight seal with the projections 71, respectively and three annular seals 79 which form seals around the three pumping chambers 31, respectively, between the inner housing section 23 and the intermediate housing section 25.

The pumping members 37 which, in this embodiment are in the form of pistons, are suitably attached to the projections 71 by screws 81 which pass through openings in the diaphragm 75. Integral pins 83 (FIG. 1) on the diaphragm 75 are received in corresponding holes 85 in each of the pumping members 37 to index the pumping members against rotation about the associated screw 81.

Figure 2A:
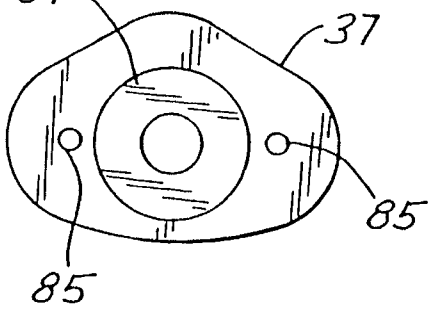
FIG. 2A is a rear view of a pumping member.

A feature of the pumping members 37 is that each of them has an annular pedestal 87 which seats on a region of the diaphragm 75 and in particular the associated seal 77. As best in seen in FIG. 2A, the pedestal 87 preferably has a circular periphery. During the wobbling or nutating motion of the wobble plate 53, the pedestals 87 on the pumping members 37 are believed to smoothly transmit the wobbling motion to the pumping members 37.

Figure 10:
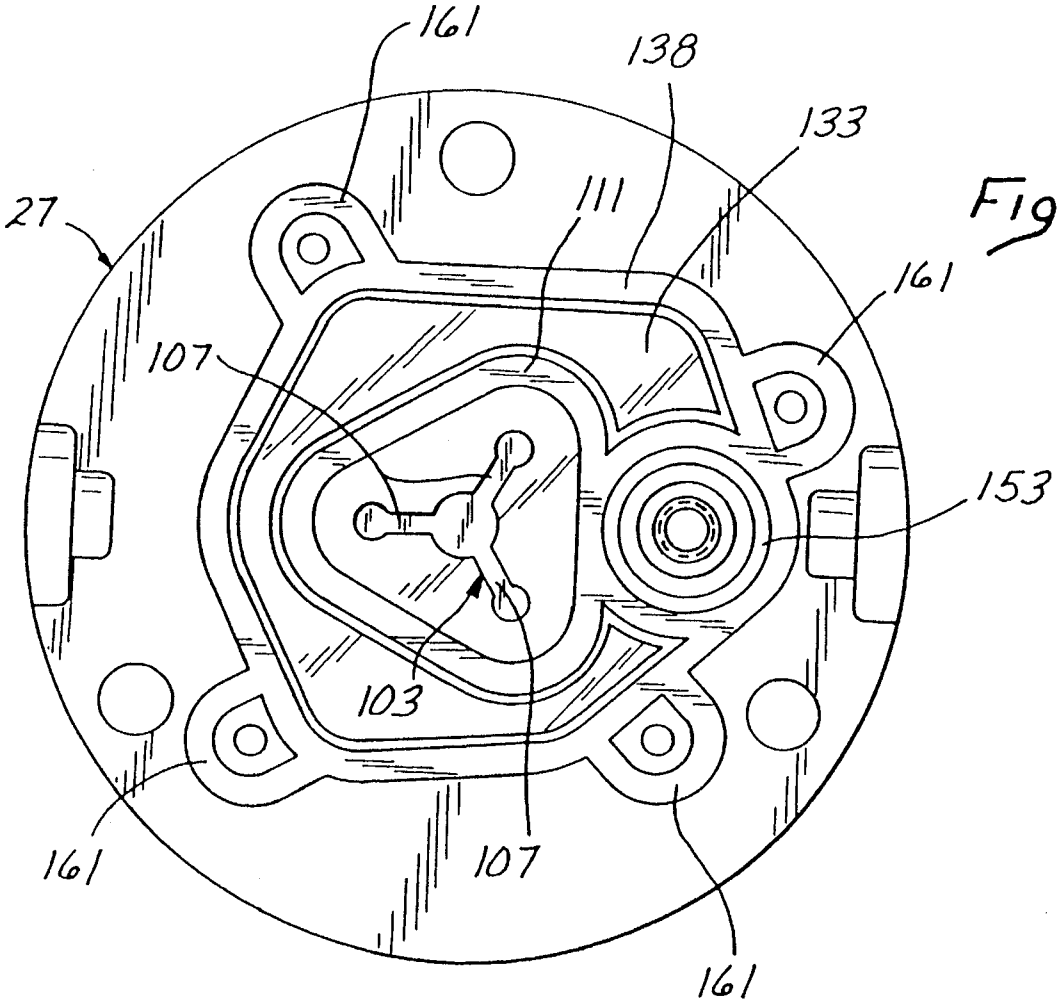
FIG. 10 is a view showing the inner face of the outer housing section.

The intermediate housing section 25, the outer housing section 27 and a gasket or diaphragm 89 cooperate to define a flow path through the housing 21 from the inlet 43 to the outlet 45. As shown in FIGS. 2 and 7, the gasket 89 is sandwiched between the intermediate housing section 25 and the outer housing section 27. An inlet passage 91 leads from the inlet 43 to each of the pumping chambers 31. More specifically, the inlet passage 91 includes a bore 93 (FIG. 7) in the intermediate housing section 25, an opening 95 (FIGS. 3, 4 and 7) in the gasket 89 and an inlet chamber 97. Three identical inlet check valves 99 are provided in the chamber 97, and the inlet passage 91 also includes three bores 101 in the intermediate housing section 25 leading from the inlet check valves to the three pumping chambers 31, respectively. The inlet chamber 97 is formed by a groove 103 (FIGS. 7 and 10) in the outer housing section 27 and by a central portion 105 (FIGS. 3 and 7) of the gasket 89. As shown in FIG. 10, the groove 103 has three legs 107 leading respectively to the three bores 101 in the central housing section 25 which lead to the three pumping chambers 31. Thus, the inlet chamber 97 is a common inlet chamber for all three of the pumping chambers 31. The inlet chamber 97 is sealed by a generally triangular shaped seal or seal ridge 109 formed integrally with the gasket 87 and received in a correspondingly generally triangular shaped groove 111 (FIGS. 7 and 10).

Each of the inlet check valves 99 includes a valve seat 113 (FIG. 7) which is a surface of the outer housing section 27 and a movable valve element 115 (FIGS. 3–5 and 7). The gasket 89 is integrally molded from a suitable resilient, flexible material such as a polymeric material or an elastomer with Santoprene being preferred, and as such forms a hinge joining each of the valve elements 115 to the remainder of the gasket 89 for pivotal movement between open and closed positions. In this embodiment, the gasket has a generally U-shaped slot 117 partially around each of the valve elements 115 to separate the valve element from the surrounding regions of the gasket.

Figure 3:
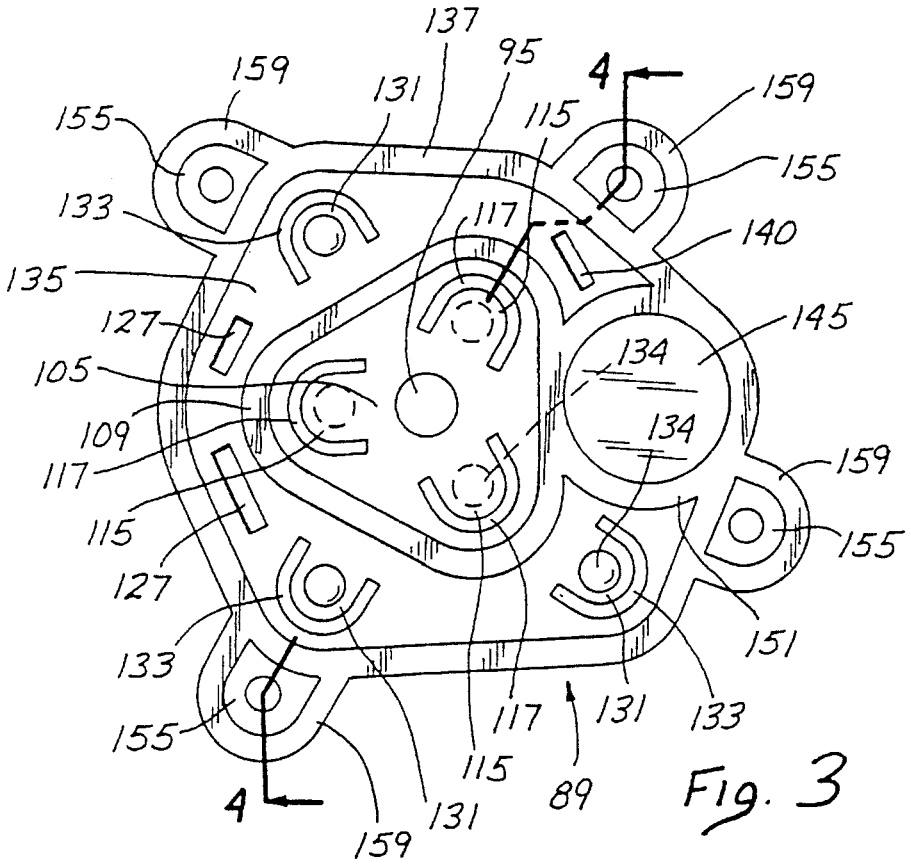
FIG. 3 is a plan view of the gasket.
Figure 8:
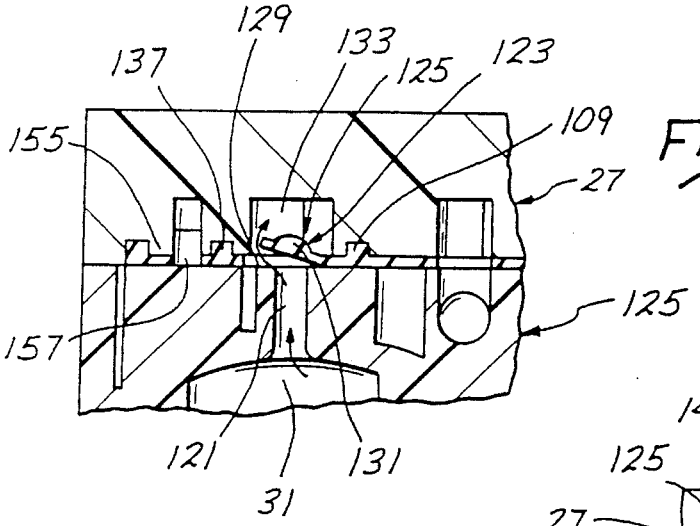
Figure 4:
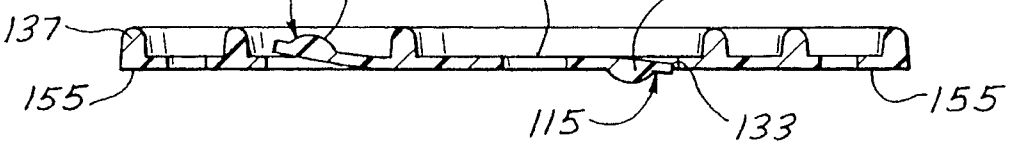
FIG. 4 is a sectional view taken generally along lines 4—4 of FIG. 3.

An outlet passage 119 leads from the pumping chambers 31 to the outlet 45. The outlet passage 119 includes three outlet bores 121 (FIGS. 2, 6 and 8) leading from the three pumping chambers 31, respectively, three identical outlet check valves 123 (FIGS. 2 and 8), an outlet chamber 125 (FIGS. 2, 7 and 8), openings 127 (FIGS. 3 and 7) in the gasket 89 and a bore 129 (FIG. 7) in the intermediate housing section 25 leading to the outlet 45. Each of the outlet check valves 123 includes a valve seat 130 (FIG. 8), which is a surface of the intermediate housing section 25, and a valve element 131. As shown in FIG. 3, there are three of the valve elements 131, one for each of the pumping chambers 31. The valve elements 131 are formed integrally with the gasket 89 in the same manner as described above for the valve elements 115, and like the valve elements 115, each of them is partially circumscribed by a generally U-shaped slot 133. Thus, the valve elements 131 can be pivoted between open and closed positions in the same manner as the valve elements 115. As best shown in FIGS. 3 and 4, each of the valve elements 115 and 131 has a central thickened region in the form of a dome 134 which strengthens the valve element.

The outlet chamber 125 is formed by a groove 133 (FIGS. 8 and 10) in the outer housing section 27 and by a correspondingly shaped zone 135 (FIG. 3) of the gasket 89 which confronts the groove 133. The gasket 89 has a seal or seal ridge 137 which cooperates with the seal ridge 109 to form a seal around the outlet chamber 125. The outer housing section 27 has a groove 138 (FIG. 10) to receive the seal ridge 137. Accordingly, the outlet chamber 125 serves as a common outlet chamber for all three of the pumping chambers 31.

The pump 15 has a bypass passage 139 (FIG. 9) which leads from the outlet chamber 125, i.e. a location in the outlet passage 119 (FIG. 7) downstream of the outlet check valves 123, to a location in the inlet passage 91 upstream of the inlet check valves 97. The bypass passage 139 includes a bypass opening 140 in the gasket 89 and a bypass passage section or groove 142 in the intermediate housing section which is covered by the gasket. A bypass valve 141 (FIG. 9) includes a bypass valve seat 143, a region 145 (FIGS. 2, 3, 5 and 9) and a biasing member in the form of a coil compression spring 147 which acts against such region of the gasket to bias such region against the valve seat 143. The spring 147 is received in a bore 149 of the outer housing section 127 and acts against a shoulder in that bore. The region 145 of the gasket 89 serves as a bypass valve element in that it cooperates with the valve seat 143 and the spring 147 to open and close the bypass valve 141. If the pressure in the outlet chamber 125 is sufficient, it will force the region 145 of the gasket 89 upwardly as viewed in FIG. 9 off of the bypass valve seat 143 so that the fluid can be returned to the inlet passage 91.

The gasket 89 has a circular seal ridge 151 (FIG. 3) surrounding the region 145 which cooperates with a correspondingly shaped groove 153 (FIG. 10) in the outer housing section 27 to seal the bore 149, which contains the spring 147 against liquid entry.

As shown in FIG. 3, the gasket 89 has mounting ears 155 and pins 157 (FIGS. 5 and 8) extend through apertures in the mounting ears 155 to locate the gasket on the intermediate housing section 125. Each of the mounting ears 155 has a seal ridge 159 which cooperates with the seal ridge 137 to completely surround the mounting ear. The outer housing section 27 has grooves 161 (FIG. 10) to receive the seal ridges 159.

Identical quick disconnect fittings 163 (FIG. 1) are provided at the inlet 43 and the outlet 45, respectively, for enabling inlet and outlet conduits (not shown) to be quickly connected to, and disconnected from, the inlet and outlet. Each of the fittings 163 includes a quick disconnect housing 165 and the components of the female portion of the fittings 163 are shown in FIG. 2 and are removed in FIG. 7. The fittings 163 are conventional except that the housings 165 are molded integrally with the intermediate housing section 25.

It can be seen from the foregoing that the gasket 89 performs many valuable functions. First, the gasket seals between the housing sections 25 and 27 and also provides the valve elements 115 and 131 for the check valves 99 and 123, respectively. The gasket 89 also cooperates with the outer housing section 27 to provide the inlet chamber 97 and the outlet chamber 125. The gasket 89 also provides the region 145 which serves as the valve element for the bypass valve 141 and provides the seal ridge 151 (FIGS. 3 and 9) to exclude the fluid being pumped from the bore 149 which houses the spring 147. The gasket 89 also provides various openings, such as the openings 95, 127 and 140 (FIG. 3) which permit fluid flow through the pump 15 from the inlet 43 to the outlet 45. Consequently, a large number of functions are obtained from a one piece, unitary member, i.e. the gasket 89, and this gasket can be integrally molded from a suitable material.

In use of the pump 15, the quick disconnect fittings 163 (FIG. 1) are coupled to inlet and outlet conduits, respectively. The motor 13 is energized to rotate the output shaft 17 (FIG. 2), the bushing 49 and the inner race 67. This causes the wobble plate 53 to wobble or nutate in a known manner to thereby drive the pumping members 37 on intake and discharge strokes which are out of phase with each other. On the intake stroke of a pumping member 37, the pumping member draws liquid from the inlet passage 91 (FIG. 7) and in particular the inlet chamber 97 through the inlet check valve 99 and the bore 101 into the pumping chamber 31. The reduced pressure caused by movement of the pumping member 37 on the intake stroke causes the valve element 115 of the check valve 99 to pivot to the open position as shown in FIG. 7. On the discharge stroke, the pumping member 37 forces fluid from the pumping chamber 31 through the outlet check valve 123 (FIG. 8), the outlet chamber 125, the openings 127 and the bore 129 to the outlet 45. During the discharge stroke, the higher pressure in the pumping chamber 31 forces the valve element 115 of the inlet check valve 99 against the valve seat 113 to a closed position. Conversely, during the intake stroke, the lower pressure within the pumping chamber 31 holds the valve element 131 of the outlet check valve 123 against its valve seat 130. This pumping action occurs in each of the pumping chambers 31, but in an out of phase relationship.

Figure 9:
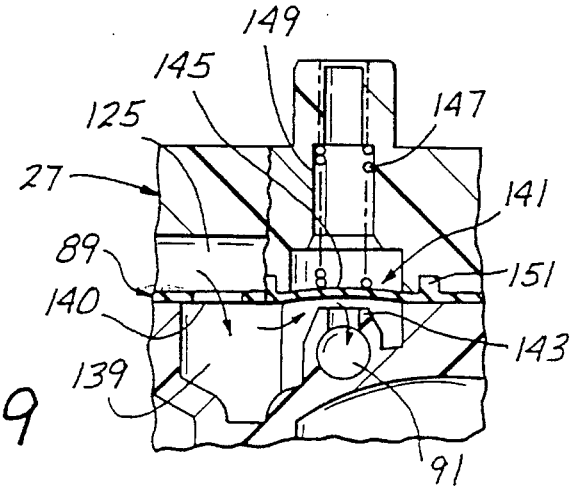
Figure 5:
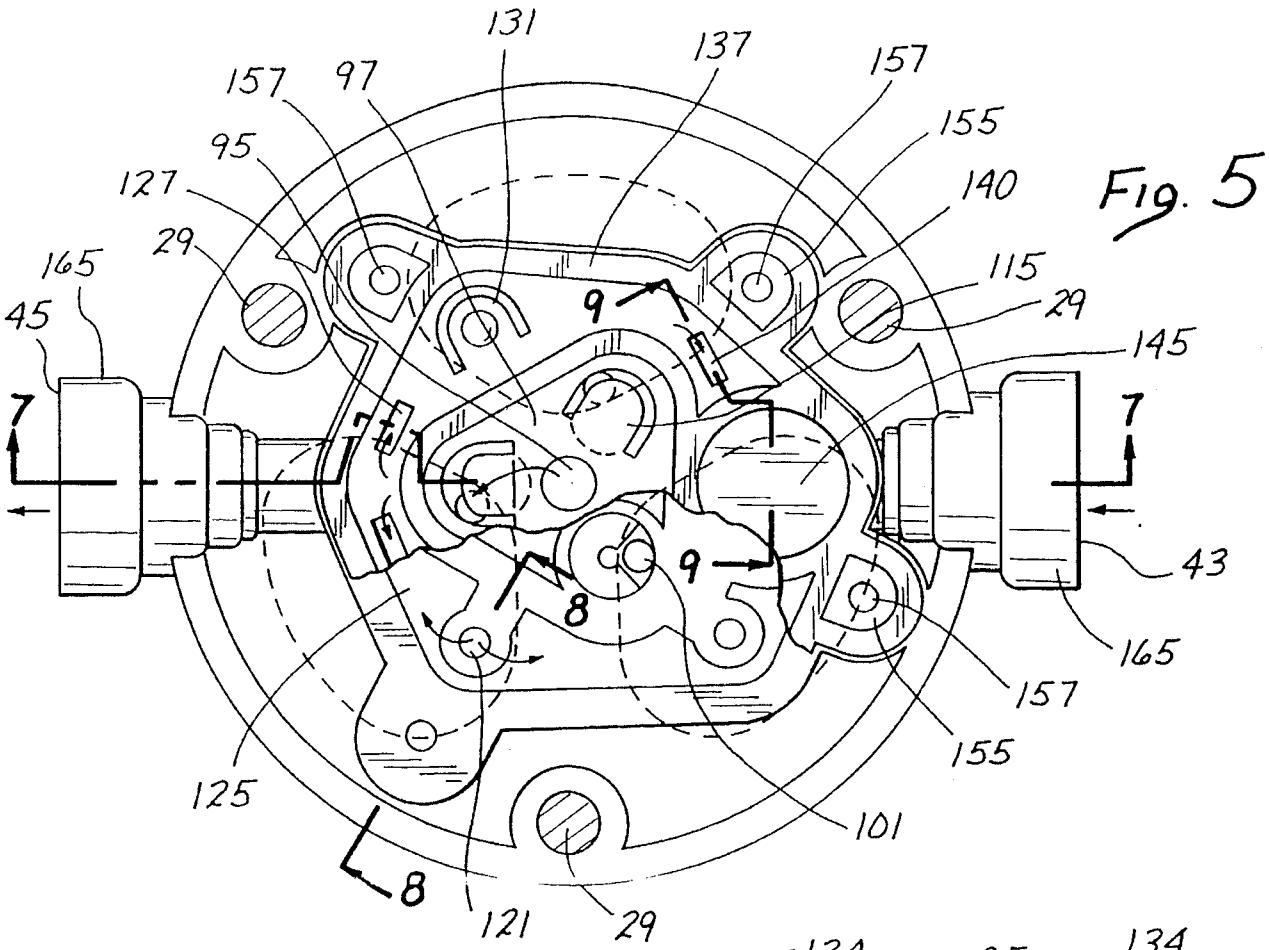
FIG. 5 is a view taken generally along line 5—5 of FIG. 2 with the outer housing section removed and with portions of the gasket broken away.

Fluid in the outlet chamber 125 also enters the bypass passage 139 to act on the region 145 of the gasket 89 as shown in FIG. 9. Under ordinary operating conditions, the force of the spring 147 is sufficient to hold the region 149 against the valve seat 143 thereby maintaining the bypass valve 141 closed. However, if the pump 15 continues operation and pressure in the output chamber 125 increases as a result of a restriction downstream of the outlet 45, the pressure in the bypass passage 139 acting against the region 145 of the gasket 89 and the spring 147 increases sufficiently to lift the region 145 off of the valve seat 143 thereby opening the bypass valve 141 and allowing flow through the bypass passage 139 back to the inlet passage 91.

Although an exemplary embodiment of the invention has been shown and described, many changes, modifications and substitutions may be made by one having ordinary skill in the art without necessarily departing from the spirit and scope of this invention.

We claim:

1. A pump comprising:

a housing including first and second housing sections;

a gasket between the first and second housing sections;

at least one fastener for holding the first and second housing sections together;

said housing having at least a first pumping chamber, an inlet, an inlet passage in the housing leading from the inlet to the pumping chamber, an outlet and an outlet passage in the housing leading from the pumping chamber to the outlet;

a first pumping member movable in the pumping chamber on an intake stroke whereby a fluid from the inlet passage is drawn into the pumping chamber and a discharge stroke whereby fluid in the pumping chamber is discharged into the outlet passage;

a drive for moving the pumping member on the intake and discharge strokes;

an inlet check valve in the inlet passage;

an outlet check valve in the outlet passage, each of said check valves including a movable valve element and a valve seat;

said gasket forming a seal between the first and second housing sections;

a bypass passage in said housing leading from a location in the outlet passage downstream of the outlet check valve to a location in the inlet passage upstream of the inlet check valve, the bypass passage including a bypass opening in the gasket; and a bypass valve including a bypass valve seat in the bypass passage, a region of said gasket and a biasing member for biasing said region of the gasket against the bypass valve seat to close the bypass passage, said region of the gasket being responsive to fluid under pressure from the outlet passage exceeding a pressure for moving off of the bypass valve seat to open the bypass passage.

2. A pump as defined in claim 1 wherein the biasing member is in a bore in the housing and the gasket includes a seal circumscribing said region of the gasket and sealing said bore.

3. A pump as defined in claim 1 including a quick disconnect coupling which includes a quick disconnect housing defining one of said inlet and said outlet and said quick disconnect housing is molded integrally with one of said first and second housing sections.

4. A pump comprising:

a housing including first and second housing sections;

a gasket between the first and second housing sections;

at a least one fastener for holding the first and second housing sections together;

said housing having at least a first pumping chamber, an inlet, an inlet passage in the housing leading from the inlet to the pumping chamber, an outlet and an outlet passage in the housing leading from the pumping chamber to the outlet;

a first pumping member movable in the pumping chamber on an intake stroke whereby a fluid from the inlet passage is drawn into the pumping chamber and a discharge stroke whereby fluid in the pumping chamber is discharged into the outlet passage;

a drive for moving the pumping member on the intake and discharge strokes;

an inlet check valve in the inlet passage;

an outlet check valve in the outlet passage, each of said check valves including a movable valve element and a valve seat;

said gasket forming a seal between the first and second housing sections;

a bypass passage in said housing leading from a location in the outlet passage downstream of the outlet check valve to a location in the inlet passage upstream of the inlet check valve, said bypass passage including a bypass opening in the gasket;

a bypass valve including a bypass valve seat in the bypass passage, a region of said gasket and a biasing member for biasing said region of the gasket against the bypass valve seat to close the bypass passage, said region of the gasket being responsive to fluid under pressure from the outlet passage exceeding a pressure for moving off of the bypass valve seat to open the bypass passage; and the biasing member located in a bore in the housing and the gasket including a raised seal ridge circumscribing said region of the gasket and sealing said bore.

5. The pump as defined in claim 4 wherein said housing includes a groove sized and shaped to receive and cooperate with the raised seal ridge.

6. A pump as defined in claim 4 wherein the outlet passage includes an outlet chamber in the second housing section at least partially defined by the gasket, and a bypass passage section in the first housing section and the valve seat of the bypass valve is on the first housing section.

7. A pump as defined in claim 4 including a quick disconnect coupling which includes a quick disconnect housing defining one of said inlet and said outlet and said quick disconnect housing is integral with one of said first and second housing sections.

8. A pump comprising:

a housing including first and second housing sections;

a gasket between the first and second housing sections;

at least one fastener for holding the first and second housing sections together;

said housing having at least a first pumping chamber, an inlet, an inlet passage in the housing leading from the inlet to the pumping chamber, an outlet and an outlet passage in the housing leading from the pumping chamber to the outlet, the outlet passage including an outlet chamber in the second housing section at least partially defined by the gasket;

a first pumping member movable in the pumping chamber on an intake stroke whereby a fluid from the inlet passage is drawn into the pumping chamber and a discharge stroke whereby fluid in the pumping chamber is discharged into the outlet passage;

a drive for moving the pumping member on the intake and discharge strokes;

an inlet check valve in the inlet passage;

an outlet check valve in the outlet passage, each of said check valves including a movable valve element and a valve seat;

said gasket forming a seal between the first and second housing sections;

a bypass passage in said housing leading from a location in the outlet passage downstream of the outlet check valve to a location in the inlet passage upstream of the inlet check valve, the bypass passage including a bypass opening in the gasket and a bypass passage section in the first housing section; and a bypass valve including a bypass valve seat on the first housing section in the bypass passage, a region of said gasket and a biasing member for biasing said region of the gasket against the bypass valve seat to close the bypass passage, said region of the gasket being responsive to fluid under pressure from the outlet passage exceeding a pressure for moving off of the bypass valve seat to open the bypass passage.

9. A pump as defined in claim 8 wherein the biasing member is in a bore in the housing and the gasket includes a seal circumscribing said region of the gasket and sealing said bore.

10. A pump as defined in claim 8 including a quick disconnect coupling which includes a quick disconnect housing defining one of said inlet and said outlet and said quick disconnect housing is integral with one of said first and second housing sections.

* * * * *

UNITED STATES PATENT AND TRADEMARK OFFICE

CERTIFICATE OF CORRECTION

PATENT NO. : 5,571,000

DATED : November 5, 1996

INVENTOR(S) : Zimmermann et al.

It is certified that error appears in the above-identified patent and that said Letters Patent is hereby corrected as shown below:

Delete the Abstract on the front page of the patent and insert in place thereof

--A pump comprising a housing including first and second housing sections and a gasket between the first and second housing sections. The housing has a first pumping chamber, an inlet, an inlet passage in the housing leading from the inlet to the pumping chamber, an outlet and an outlet passage in the housing leading from the pumping chamber to the outlet. A pumping member is movable in the pumping chamber to pump fluid through the pump. Inlet and outlet check valves are provided in the inlet and outlet passages, respectively with each of the check valves including a movable valve element. The gasket forms a seal between the first and second housing sections. A bypass passage in the housing leads from a location in the outlet passage downstream of the outlet check valve to a location in the inlet passage upstream of the inlet check valve. A bypass valve is provided and includes a bypass valve seat in the bypass passage, a region of the gasket and a biasing member for biasing the gasket region against the bypass valve seat to close the bypass passage.--

UNITED STATES PATENT AND TRADEMARK OFFICE

CERTIFICATE OF CORRECTION

PATENT NO. : 5,571,000

DATED : November 5, 1996

INVENTOR(S) : Zimmermann et al.

It is certified that error appears in the above-identified patent and that said Letters Patent is hereby corrected as shown below:

Column 3, line 29; delete "function" and insert in place thereof --function, in--.

Column 3, line 31; delete "meter" and insert in place thereof --motor--.

Claim 6, delete "and" and insert in place thereof --said bypass passage includes--.

Signed and Sealed this

Tenth Day of April, 2001

*Attest:*

Nicholas P. Godici

NICHOLAS P. GODICI

*Attesting Officer*

*Acting Director of the United States Patent and Trademark Office*